United States Patent [19]

Nachbar

[11] Patent Number: 4,920,994

[45] Date of Patent: May 1, 1990

[54] LASER REMOVAL OF SLUDGE FROM STEAM GENERATORS

[75] Inventor: Henry D. Nachbar, Ballston Lake, N.Y.

[73] Assignee: The United States of America as represented by the United States Department of Energy, Washington, D.C.

[21] Appl. No.: 406,002

[22] Filed: Sep. 12, 1989

[51] Int. Cl.[5] ..... B08B 7/00; F28G 13/00

[52] U.S. Cl. ..... 134/1; 134/18; 122/379; 165/95

[58] Field of Search ..... 376/310, 326; 134/1, 134/18, 25.1, 25.4; 122/379; 165/95; 219/121.85

[56] References Cited

U.S. PATENT DOCUMENTS

| | | | |
|---|---|---|---|
| 4,207,874 | 6/1980 | Choy | 15/300 R |
| 4,421,048 | 12/1983 | Adema et al. | 134/19 |
| 4,588,885 | 5/1986 | Lovoi et al. | 134/38 |
| 4,671,848 | 6/1987 | Miller et al. | 219/121.85 |
| 4,676,586 | 6/1987 | Jones et al. | 219/121.85 |
| 4,689,523 | 8/1987 | Fowler | 134/1 |
| 4,756,765 | 7/1988 | Woodroffe | 134/1 |
| 4,867,796 | 9/1989 | Asmus et al. | 134/1 |

OTHER PUBLICATIONS

Graham, Frank D., Power Plant Engineers Guide, 3d ed. (Indianapolis, 1983), pp. 46, 47, 111,115, 125-126, 518-531.

Laurence, Clifford L., The Laser Book: A New Technology of Light, 1st ed. (New York, Prentice Hall, 1986), pp. 73-74, 91, 137-140, 147-149.

Woodruff et al., Steam Plant Operation, 4th ed. (New York, McGraw Hill, 1977), pp. 3-4, 6-7, 42, 55-57, 263-269, 306-309.

Coherent, Inc., Lasers (New York, McGraw Hill, 1980), pp. 24, 26-27, 34-35, 37-38, 48-49, 100-101.

*Primary Examiner*—Daniel Wasil

*Attorney, Agent, or Firm*—William R. Moser; Judson R. Hightower; Richard E. Constant

[57] ABSTRACT

A method of removing unwanted chemical deposits known as sludge from the metal surfaces of steam generators with laser energy is provided. Laser energy of a certain power density, of a critical wavelength and frequency, is intermittently focused on the sludge deposits to vaporize them so that the surfaces are cleaned without affecting the metal surface (sludge substrate). Fiberoptic tubes are utilized for laser beam transmission and beam direction. Fiberoptics are also utilized to monitor laser operation and sludge removal.

13 Claims, 2 Drawing Sheets

LASER REMOVAL OF SLUDGE FROM STEAM GENERATORS

I. GOVERNMENT CONTRACT

The present invention was conceived and developed in the performance of U.S. Contract DE-AC12-76SN00052.

II. FIELD OF THE INVENTION

This invention relates to a method for removing unwanted chemical deposits, known as sludge, from steam generator surfaces, especially those found in nuclear power generators, by vaporization without affecting the base structural surface. The invention further relates to a system capable of monitoring the vaporization at the work site.

III. DESCRIPTION OF THE PRIOR ART

A boiler carries a considerable volume of water in proportion to its heating surfaces In contrast, a steam generator carries no excess volume of water, but converts the water into steam as it traverses the heating surface. In a nuclear generator, the furnace for burning conventional organic fuels is replaced by a reactor which contains a core of nuclear fuel. Steam is produced by transferring the heat produced by fission through a heat exchanger (steam generator). Output from the reactor is controlled by positioning the control rods to vary the chain reaction and to satisfy steam demands. The heat exchanger is comprised of a metallic shell and tubes which are filled with coolant water which is circulated around the reactor. This is superheated primary water. Secondary water is circulated around the tubes containing the superheated water. This secondary water is heated and used to run a steam turbine as explained by Graham, *Power Plant Engineers Guide,* T. Audel, 1983.

Water, when heated and always on becoming steam, is separated from any impurities which it may have contained such as chlorine, fluoride, iron, nickel, zinc, calcium, copper and various salts thereof. These form sediment and encrustation. When these deposits form on the tubes and shell of a heat exchanger, the secondary water is unable to remove the heat; and the metal may reach a temperature high enough to reduce its tensile strength. The weakened metal may yield to the pressure and produce a protrusion known as a "bag". This bag produces a pocket for the accumulation of impurities which eventually cause failure. Thus, these deposits must be removed, or loss of efficiency and generator outages will result. Woodruff, *Steam Plant Operation,* McGraw Hill, 1977.

In the past, two methods of cleaning steam generators have been used: mechanical means, including water lance jetting, scraping, and boring; and chemical means. (See Graham). These methods require partial disassembly of the structure for access by men and equipment.

Water lance jetting, which often serves as the primary means for steam generator sludge removal, involves the use of a pipe made of a special alloy to withstand high temperatures which serves as a conduit or mechanical support for nozzles, through which water with shot is transmitted at high velocity. The size, design and location of the nozzles vary to meet the cleaning needs encountered in the generating tube bank and other heat-exchange equipment. Removal of the wet sludge is then effected through a valve especially constructed to provide a means for discharging impurities.

Water jetting is most effective on soft sludge in steam generators; and the process is less effective or impossible on hard sludge as it is known to exist in steam generators. Hard sludge takes an excessive amount of time to water jet and has the added disadvantage of creating local polishing of metal surfaces when sludge that has broken loose is impacted against base metal surfaces. This local polish effect is commonly called local erosion.

Chemical cleaning procedures have been successfully applied to boiler interiors and heat exchangers and are somewhat less time consuming and tedious then mechanical cleaning methods. Chemical cleaning methods are better adapted to units with small or bent tubes. However, chemical cleaning requires an analysis of scale samples to determine scale type and then choosing the correct cleaning solution. The solution must be made with a knowledge not only of the scale, but also of the material from which the heat exchanger is constructed. The solution must be made selectively so that it will dissolve the scale without corroding the metal surface. The solution is analyzed during the operation to check the progress in cleaning. When analysis shows that the unit is clean, the solvent is removed and a neutralizing solution is introduced. After the unit has been drained and flushed with water, it is ready for service.

Both chemical and mechanical methods require a significant amount of down time for the steam generator and man-hours for cleaning and monitoring the system.

The removal of material by vaporization, with the introduction of energy from the use of lasers, is well known. See Laurence, *The Laser Book,* New York, 1986. Removal of dirt, grime and corrosion products from various material composition surfaces has been accomplished without destroying the original surface. Examples of the above are dirt removal from granite, grime removal from copper and gold on FIBERGLAS printed circuit boards and removal of deposits in human arteries. However, this cleaning has been done manually with continuous operation, red or ruby lasers.

Vaporization of impurities such as those which may be found in water requires extremely high temperatures, often exceeding 750 degrees C. If the metal surfaces of the heat exchange unit or steam generator are raised to such temperatures, their temper or strength would be compromised, leading to failure of the unit. The use of continuous operation ruby lasers as discussed by Laurence is inappropriate for cleaning heat exchanger surfaces. Further, it is critical that the operation of the laser be monitored.

What is desired is a method capable of removing sludge from metal surfaces without affecting the original base metal surface (subsurface of the sludge) and a method of on-site monitoring of the work.

An object of the present invention is to provide an improved system for removing chemical deposits from nuclear steam generators, thereby increasing the efficacy with which sludge may be removed and increasing the surface areas which may be reached by cleaning without extensive disassembly of the structure cleaned.

A further object of the present invention is to provide a laser vaporization method of sludge removal which has a minimum temperature effect on the metal surfaces and which does not destroy the metal surfaces or contribute to a local polish effect.

An even further object of this invention is to provide a method capable of monitoring, visually, the work progress at the precise work location and providing a completely automated system.

SUMMARY OF THE INVENTION

The objects of the present invention are realized in a sludge and sediment removal method using a laser to vaporize unwanted chemical deposits from metal steam generator surfaces. The laser system is operated as a cold $CO_2$ laser which is pulse powered and critically focused.

This method requires no water at the work zone, thus eliminating the need to remove wet sludge. The method permits the exhaust of vaporized sludge products by conventional air delivery, circulation, and removal methods, including HEPA filters, as required, thereby making the removal of separated sludge products simpler than with wet cleaning methods.

A laser is used to vaporize sludge deposits. The water normally resident in the generator unit is available in the tubes to cool them from their inside surfaces, thus providing an additional precaution against elevated surface metal temperatures.

Fiberoptic viewing devices are used to identify and monitor the laser application at the work location. Fiberoptics are also used to transport laser energy around corners and down tube lanes, thus improving sludge removal in difficult to reach areas. Control and computer equipment is remotely installed and provides for a completely automated system.

V. DESCRIPTION OF THE DRAWINGS

The features, operation and advantages of the present invention will be readily understood from a reading of the following Detailed Description of the Invention in conjunction with the attached drawings in which like numerals refer to like elements and in which.

DETAILED DESCRIPTION OF THE INVENTION

Figure 1:
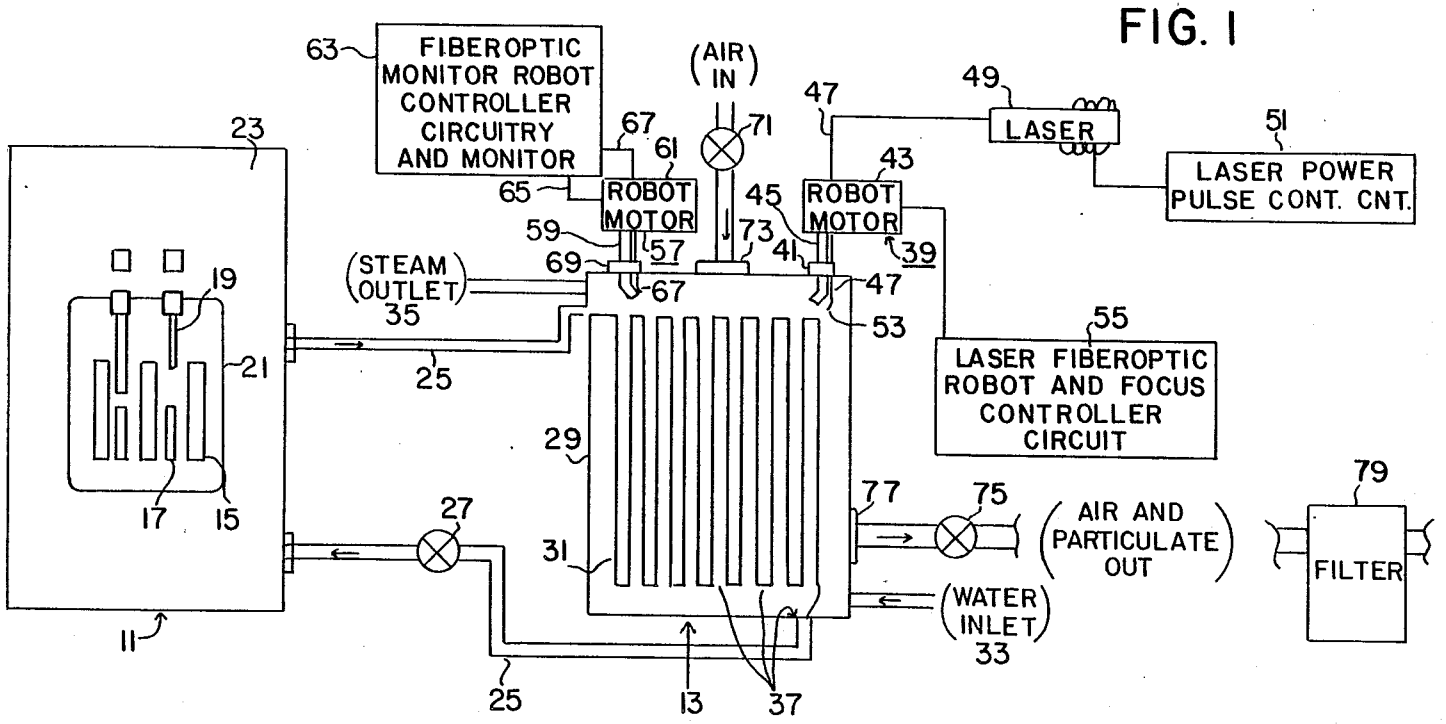
FIG. 1 shows a crossectional elevational view of a nuclear steam generator system with the robot carried laser powered and fiberoptic delivered sludge cleaning system installed on the heat exchanger unit, including the fiberoptic monitor.

A power generating plant, such as a nuclear generator, has a heat source, reactor 11, FIG. 1, and a heat exchange unit, heat exchanger 13. The reactor 11 includes radioactive fuel materials 15, moderators 17, and control rods 19 within a sealed nuclear core or pressure vessel 21.

The core 21 is surrounded by cooling jacket 23 in which cool fluid, usually water, is circulated. This water is typically termed primary cooling water.

This primary cooling water is circulated from the cooling jacket 23 through piping 25 to the heat exchanger 13. Circulation is usually effected by a pump 27.

The heat exchanger 13 has water-tight outer walls 29 surrounding a plurality of heat exchange tubes 31. These tubes 31 typically transverse the space within the walls 29 and are connected to the primary water piping 25. The cooling jacket 23, piping 25 and heat exchange tubes 31 comprise a pressurized system in which the primary cooling water is in the superheated state.

Secondary cooling water is pumped into the heat exchanger 13 through a water inlet 33. This secondary water passes over the heat exchange tubes 31 and is heated into steam which is moved by a steam outlet 35 which is connected to a steam turbine (not shown).

As the secondary water is heated, and especially as it changes into steam, chemicals and particulate matter normally in the water separate out and form a sludge or sediment 37 on the surfaces of the tubes 31 and the walls 29 of heat exchanger 13. This sediment 87 is typically metal and metal salt based, containing such elements as chlorine, fluoride, iron, nickel, zinc, calcium, copper and various salts and oxides thereof.

As stated above, periodic cleaning by removal of this sediment is necessary to maintain the efficiency of the heat exchanger and to guard against structural failure.

In the embodiment shown in FIG. 1, a first robot system 39 is installed to operate within the heat exchanger 13 through a first access hatch 41. This robot system 39 includes a robot motor 43 and a robot arm system 45. The arm system 45, which will be discussed in greater detail below, carries a first fiberoptic transmission tube or pipe 47.

This first fiberoptic transmission pipe 47 carries a laser beam from a $CO_2$ laser 49 to its terminus at the end of the robot arm system 45 positioned within the heat exchanger.

The laser 49 is operated from a connection from a control circuit 51. The operation of this control circuit 51 and the laser 49 beam generated will be discussed below.

The robot motor 43, and therefore, the location and focusing of the laser beam 53 within the heat exchanger 13 and upon the sediment 37 coated surfaces of the tubes 3!, is controlled by a robot and focus controller circuit 55.

A second separate fiberoptic robotic system can be used to monitor the operation of the laser fiberoptic robotic system.

A second robot system 57 is similar to, if not identical to, the first robot system 39. It contains a second robot arm system 59 operated by a motor 61. The motor 61 is controlled from a fiberoptic monitor robot controller circuitry 63 and a display monitor through control lines 65. A second, separate, fiberoptic viewing/monitor pipe or tube 67 is mounted on the second robot arm system 59.

The second robot system 57 operates within the heat exchanger 13 by accessing its interior through a second access hatch 69.

The second robot system 57 can be operated in conjunction with the first robot system 39 and the laser 49.

The effect of the laser beam 53 on the sediment 37 can be viewed at the work site, i.e., the point of vaporization of the sediment 37. The monitoring permits better control and positioning of the working laser beam 53.

Sediment 37 is vaporized under the heat created by the laser beam 53. The vaporized particles can be carried away through an air removal system. This can include an inlet air pump 71 pressurizing at least one location 73 of the heat exchanger 13 and an outlet air pump 75 evacuating at at least a second location 77 of the heat exchanger 13. A filter system 79 is down line from the evacuating air pump 75.

Figure 2:
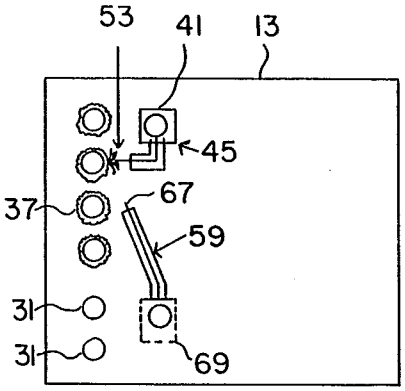
FIG. 2 shows a top view partial illustration of the fiberoptic laser delivery robot and the fiberoptic monitor robot operating during cleaning of a heat exchange tube.
Figure 5:
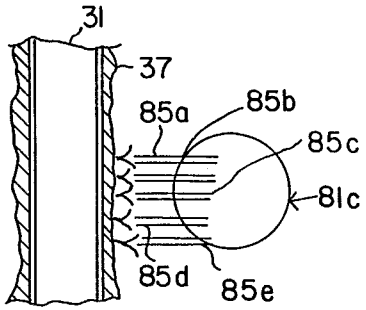
FIG. 5 shows a partial sectional elevational view of a gang probe, multi-laser beam head providing a band of power focused on the sludge surface.

The second robot arm system 59, FIG. 2, which is operated through its own access opening 69 manipulates to extend the monitoring fiberoptic pipe 67 in close proximity to the vaporizing laser beam 53 operating upon the sludge/sediment layers 37 on the heat exchanger tubes 31

Figure 3:
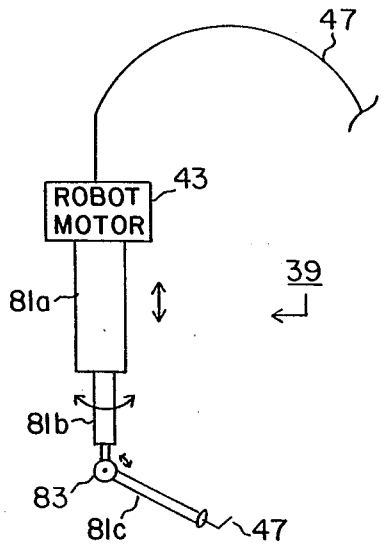
FIG. 3 shows a block diagram of a fiberoptic laser light delivery robot.

The laser delivery robot arm system 39 is shown in greater detail in FIG. 3. This system 39 can be of any design which will position the end of the laser transmission fiberoptic pipe 47 within the heat exchanger 13. Many suitable designs are available in the marketplace. As an example, robot motor 43 can control the extension of a series of extension members 81*a*, 81*b*, 81*c* which can extend, retract and rotate. A cable operated pivot member 83 can also be used.

Figure 4:
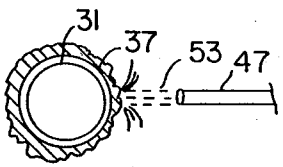
FIG. 4 shows a close-up partial sectional view of the focusing of laser light to vaporize a sludge coating over the base structural metal.

The end of the fiberoptic pipe 47, FIG. 4, is positioned as a function of the pulse rate, frequency, wave length and power density of the laser beam 53 so that the surface of the sediment 37 is vaporized without significant heating of the base metal, i.e. the tube 81. Sucessive layers of the sediment are thereby removed.

When more laser power is available and speed is a concern, multiple laser transmission pipes 85*a*, 85*b*, 85*c*, 85*d*, 85*e* can be mounted for delivery by the robot arm extension member 81*c* to deliver a "path" wide vaporization. Each fiberoptic pipe 85*a*–85*e*, and therefore, each laser beam is focused about twice the beam width apart to create a beam path of plural laser beams. This can also be accomplished by a multiple focus device.

Figure 6:
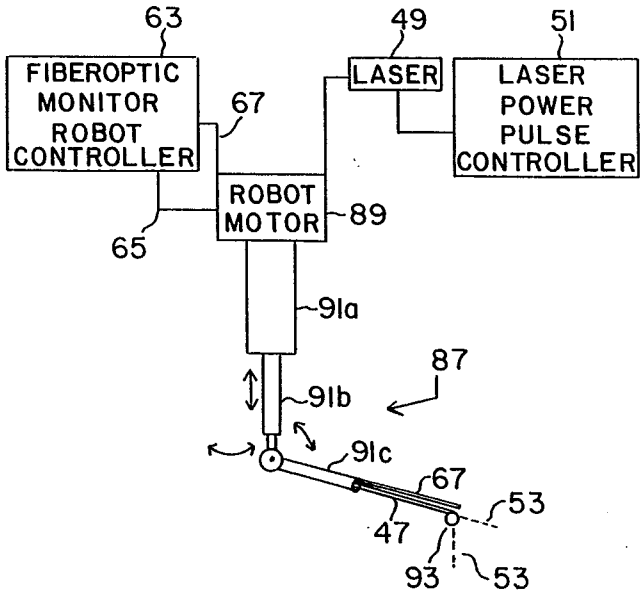
FIG. 6 shows a block diagram of an alternate embodiment of a robot capable of fiberoptic laser light delivery and monitoring.

As an alternative to the two robot system of FIGS. 1 and 3, a dual function single robot system 87, FIG. 6, can be used. This system 87 incorporates a single motor 89 and extension members 91*a*–91*c*, and has the two fiberoptic pipes 47, 67 mounted thereon. As before, the first pipe 45 is dedicated to transmit the laser 49 beam while the second pipe 67 is used for monitoring. The same laser power pulse controller circuit 51 and same fiberoptic monitor robot controller and monitor circuit 63 is also used.

However, a multiple focus lens device 93 is positioned at the end of the laser fiberoptic pipe 47 which will allow for multiple direction focusing of the laser beam 53. This beam 58 can be focused straight ahead or at angles thereto by using the focusing device 93.

Figure 7:
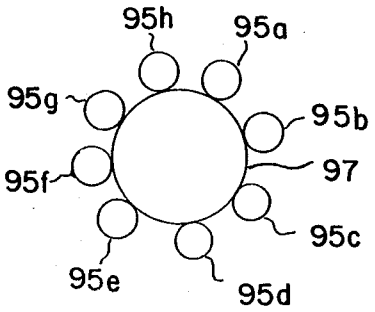
FIG. 7 shows an enlarged crossectional view of a probe with multiple fiberoptic focusing devices.

The multiple focusing device 93 of FIG. 6 may take the alternate structure shown in FIG. 7. Here plural laser fiberoptic transmission pipes 95*a*–95*h* are positioned about a robot extension member 96. The focal length of laser beams eminating from each of the fiberoptic transmission pipes 95*a*–95*h* can be adjusted in unison by focusing means at the terminus of each pipe 95*a*–95*h*.

The laser beam fiberoptic transmission and focusing structures and the methods of their use are generally known to those of ordinary skill in that art and need not be discussed further here.

Removal of sludge deposits 37 is accomplished by the heat generated at the focal distance of a laser beam. Pulse rates of from 25 to 100 pulses per second with pulse widths of from 4 to 10 milliseconds are used for generating the laser beam. This means that the laser beam is operated intermittantly. This intermittant laser operation allows for time periods when laser heat of vaporization is removed and heat build up in the substrate base materials of the heat exchanges can be dissipated into the mass of the materials. In this manner the heat exchanger materials are not damaged by the laser beam heat.

The laser beam can be operated in the far infrared region ranging from 9 to 11 micrometers. The most powerful emission is at about 10.6 micrometers.

The cleaning process using pulsed laser power can be conducted while the heat exchanger tubes 31 are full with water at ambient temperature. This will aid in the heat dissipation during laser cycle times.

Modifications can be made in the above-described invention without departing from the intent and scope thereof. It is intended, therefore, that the embodiments disclosed above are to be interpreted as illustrative of the invention and not that the invention is to be limited thereto.

What is claimed is:

1. A method of removing sludge from steam generator interior surfaces, comprising the steps of:

generating a source of coherent light energy being laser light;

accessing the interior surfaces of said steam generator with a fiberoptic transmission pipe;

transmitting said laser light into said steam generator sludge surface through said fiberoptic transmission pipe;

focusing said laser light from said fiberoptic transmission pipe onto said sludge surface; and vaporizing said sludge with the energy of said focused light.

2. The method of claim 1 also including after the step of vaporizing, the step of removing said vaporized sludge particles with air delivery, circulation and removal apparatus.

3. The method of claim 2 wherein said source of coherent light generation steps includes:

generating said coherent light by power activating a $CO_2$ gas laser; and pulsing said power activation of said $CO_2$ gas laser to produce pulsed laser light.

4. The method of claim 3 wherein said pulsing is at a relatively slow pulse rate.

5. The method of claim 4 wherein said slow pulse rate pulsing is from about 25 to 100 pulses per second.

6. The method of claim 5 wherein said pulsing step operates to generate laser light pulses having a pulse length in the range of about 4 to 10 milliseconds.

7. The method of claim 6 wherein said coherent light is in the far infrared range around 10.6 micrometers wave length.

8. The method of claim 3 also including the step of monitoring the laser vaporization with a fiberoptic monitoring system.

9. The method of claim 8 also including controlling the position of said laser light focusing remotely from a control unit and controlling the position of said monitoring fiberoptics remotely from a control unit.

10. The method of claim 9 wherein said step of controlling the position of said laser light focusing includes mounting said laser light fiberoptic transmission pipe on a robot device and positioning said robot device with the operation of said control unit.

11. The method of claim 10 wherein said step of controlling the position of said monitoring fiberoptics includes positioning said monitor fiberoptics with a second robot device controlled from said control unit.

12. The method of claim 2 wherein the step of focusing said laser light from said fiberoptic transmission pipe onto said sludge surface includes creating a plurality of laser light emission points separated by a distance of about twice the beam width, said emission points being aligned to create a laser light sweep.

13. The method of claim 10 wherein said step of controlling the position of said monitoring fiberoptics includes positioning said monitor fiberoptics with said robot device controlled from said monitoring fiberoptics control unit.

* * * * *